United States Patent [19]

Pearlman et al.

[11] Patent Number: 5,010,703

[45] Date of Patent: Apr. 30, 1991

[54] WALLBASE MOLDING STRIP

[76] Inventors: Mort Pearlman, 7360 SW 16th Street, Plantation, Fla. 33317; Neal V. Valkenburg, P.O. Box 224, Astatula, Fla. 32705

[21] Appl. No.: 409,956

[22] Filed: Sep. 18, 1989

Related U.S. Application Data

[63] Continuation of Ser. No. 237,576, Aug. 26, 1988, abandoned.

[51] Int. Cl.[5] ..... E04F 19/04

[52] U.S. Cl. ..... 52/288; 52/273; 52/287

[58] Field of Search ..... 52/288, 287, 273

[56] References Cited

U.S. PATENT DOCUMENTS

| | | | |
|---|---|---|---|
| 2,845,666 | 8/1958 | Knapp | 52/287 |
| 3,200,547 | 8/1965 | Johnson | 52/288 |
| 3,201,909 | 8/1965 | Grün | 52/287 |
| 3,638,374 | 2/1972 | Harby | 52/288 |
| 4,052,830 | 10/1977 | Smith | 52/288 |
| 4,525,966 | 7/1985 | Litchfield et al. | 52/775 |
| 4,760,681 | 8/1988 | Harrison | 52/288 |

FOREIGN PATENT DOCUMENTS

| | | | |
|---|---|---|---|
| 641869 | 4/1964 | Belgium | 52/287 |
| 1193404 | 11/1959 | France | 52/775 |
| 1218223 | 5/1960 | France | 52/287 |
| 1279333 | 11/1961 | France | 52/288 |
| 9037 | 4/1913 | United Kingdom | 52/288 |
| 379593 | 9/1932 | United Kingdom | 52/273 |
| 1023190 | 3/1966 | United Kingdom | 52/288 |

*Primary Examiner*—Michael Safavi

*Attorney, Agent, or Firm*—Warren L. Franz

[57] ABSTRACT

A wallbase molding strip is provided with a vertical back portion and a skirt portion extending outwardly and downwardly from a front surface along a first line intermediate the upper and lower edges of the back portion, and a self-hinge in the form of a longitudinal recess located for the full length of the strip on the back of the strip below the skirt portion. The self-hinge functions to permit the strip to be selectively used either with a bottom part in a vertical position for placement over thick flooring material or with the bottom part in a forwardly folded position for placement over thin flooring material.

9 Claims, 1 Drawing Sheet

WALLBASE MOLDING STRIP

This application is a continuation of application Ser. No. 237,576, filed Aug. 26, 1988, now abandoned.

This invention relates to improvements in molding strips having a concealing curved surface providing a smooth finish at a junction between flooring material and a wall.

BACKGROUND OF THE INVENTION

In laying carpet, linoleum or other flooring materials, it is customary to use a finishing member at the intersection of the flooring material with a wall for hiding the raw edges of the flooring. Finishing members in the form of elongated flexible coves or molding strips of rubber, linoleum, polyvinylchloride or similar resilient materials, providing a vertical back portion that abuts the wall and an outwardly and downwardly extending skirt or flange portion that provides a smooth concave transition to the flooring, are well known. Examples of such molding strips are set forth in U.S. Pat. Nos. 2,300,084; 3,549,471; and 3,638,374. Such moldings ordinarily come with the skirt portion that overlays the flooring either connected at the bottom of the base portion in the manner of a flexible toe (see, e.g., U.S. Pat. No. 2,300,084) or connected integrally at an intermediate point of a front surface of the back portion (see, e.g., U.S. Pat. No. 3,638,374).

In laying conventional thin flooring materials, such as ⅛" to ¼" linoleum tile or sheet flooring, wallbase molding strips are often applied after the flooring so that the skirt portion presses down onto the flooring at a feathered leading edge a slight distance away from the wall. However, because later application of the base risks damaging carpet with adhesive, conventional carpet practice is to apply the wallbase molding before installation of the carpet. This necessitates either proper positioning of a bottom end skirt member above the level of the floor, or the use of the intermediate located skirt-type molding strip, so that the carpet edge can be securely and snugly tucked under the molding strip skirt. Intermediate located skirting strips are not useable for both carpeting and thinner flooring because of the variation in thickness of the materials. Carpeting requires approximately ½" clearance below the leading edge of the skirt and the floor under which to tuck a carpet; linoleum flooring requires only a ¼" clearance. Accordingly, different molding strip configurations have been developed for thinner flooring and thicker flooring.

SUMMARY OF THE INVENTION

It is an object of the present invention to provide a wallbase molding strip useable as a wall interface for both thick and thin flooring materials.

In one aspect of the invention a molding strip is provided having a vertical back portion and a skirt portion extending outwardly and downwardly from a front surface of the back portion along a line intermediate its top and bottom edges, and means for facilitating the optional and selective folding of a lower part of the back portion forwardly to reduce the vertical dimension of the back portion below the skirt, so that the molding can be used with the bottom part in vertical position for tucking thicker flooring materials underneath the strip or with the bottom part folded for receiving thinner flooring materials.

In a preferred embodiment, discussed in greater detail below, a recess running the full length along a rear surface of the strip below the point at which the skirting joins the vertical portion provides a self-hinge arrangement for folding the bottom part of the vertical portion, when desired.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DESCRIPTION OF THE PREFERRED EMBODIMENTS

Figure 1:
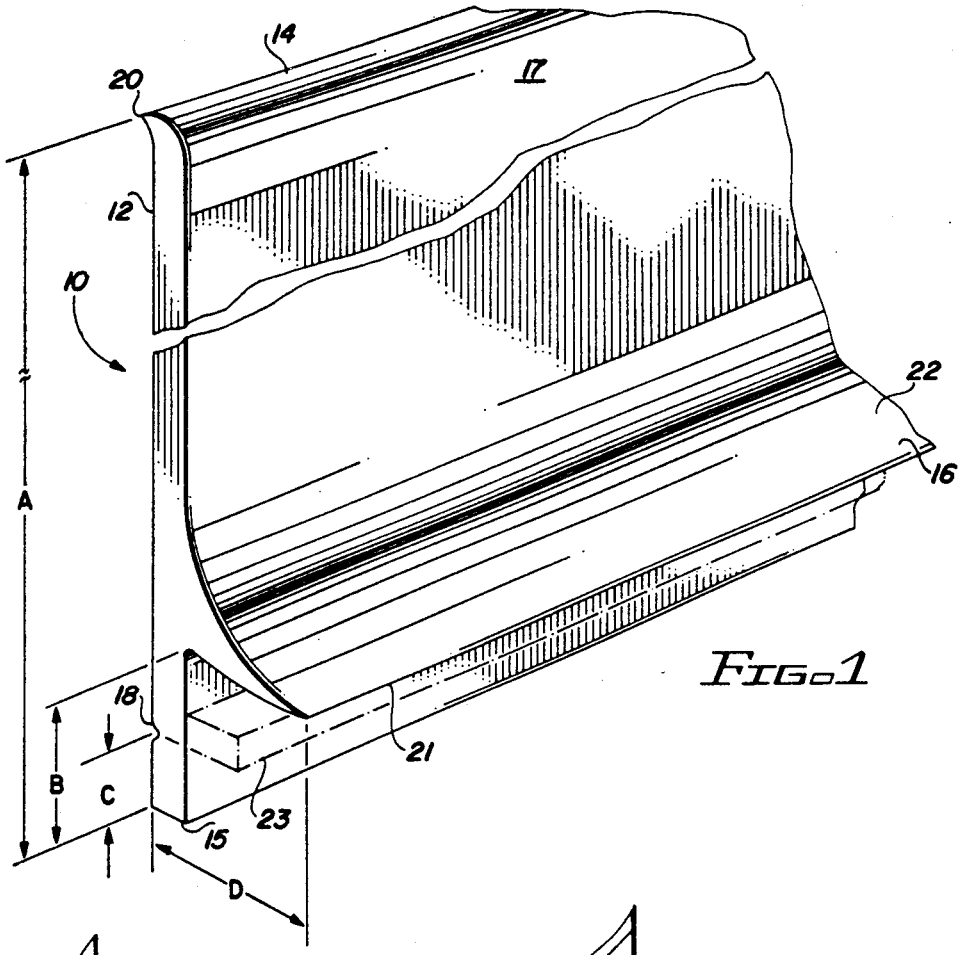
FIG. 1 is a fragmentary perspective view, partly in section, of an improved wallbase molding strip in accordance with the present invention.

As shown in FIG. 1 an elongated wallboard base molding strip 10 of conventional water impervious, flexible resilient rubber, linoleum, polyvinylchloride or other molding strip materials has a vertical back portion 12 having a rounded top edge 14 and a straight bottom edge 15. A flange or skirt portion 16 projects outwardly and downwardly from a line lengthwise intermediate the top and bottom edges 14, 15 of a front surface 17 of the back portion 12. A recess in the form of a V-shaped notch 18 extends lengthwise along a second line intermediate the top and bottom edges 14, 15 at a point approximately one-half way between the first line and the bottom edge 15. The top edge 14 is curved to a sharp rear line 20 and may be conventionally, resiliently prestressed in a rearward direction to fit tightly against a wall surface and accommodate slight irregularities in that surface. The purpose of the curvature of the edge 14 is to provide a pleasing, smooth and continuous transition from the forward surface 17 of the strip 10 back to the wall against which it abuts.

The skirt or lip 16 is tapered to a feather edge 21 and contoured with an upper concavity 22 to provide a smooth and continuous, aesthetically pleasing transition from the upper surface of overlapped flooring material (see FIGS. 2 and 3) to the surface 17 of the strip 10. The tapering of the portion 16 is done in accordance with well-known principles to provide increased flexibility to the leading edge of the portion 16 that assists in tucking flooring materials beneath the skirt.

In its preferred form, the strip 10 including back portion 12 and skirt portion 16 is formed as an integral member by continuous extrusion through a die, or similar well-known method of fabrication. The top edge 14 and bottom edge 15 are preferably parallel, and parallel to the line of joinder between the portion 16 and the portion 12 and to the recess 18.

The recess 18 extends the full length of the strip 10 and serves in the manner of a self-hinge to permit the optional bending of the bottom part 23 of the back portion 12 located between the recess 18 and bottom edge 15 forwardly along the recess 18 as a hinge line. This brings the part 23 from a vertical position in line with the remainder of the back portion 12 (as shown in solid lines in FIG. 1), to a horizontal position (shown in dot-dashed lines in FIG. 1) bent 90° forward from the vertical. This forwardly foldable feature of the base of the portion 12 enables the dimension of the portion 12 below the skirt 16 to be optionally reduced, simultaneously lowering the normal elevation of the leading edge 21 of the skirt 16 above the base of the strip 10.

Figure 2:
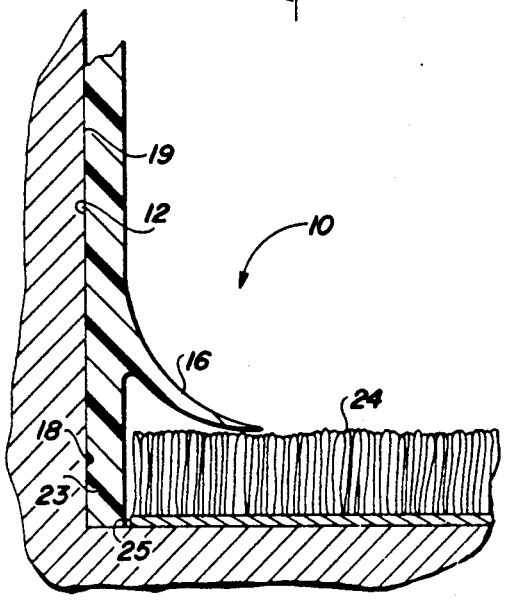
FIGS. 2 and 3 are fragmentary, vertical sections showing the strip of FIG. 1 being utilized at a wall juncture with thick and thin flooring materials, respectively.

FIG. 2 shows the strip 10 of FIG. 1 utilized with the bottom part 23 in its vertical position in line with the remainder of the back portion 12, as a molding strip to hide the edges of a thick flooring material such as carpeting 24. In a typical application, the strip 10 is cemented with its back surface in abutment with a wall 19 and its bottom edge standing on the subflooring. The added flexibility of the skirt portion 16 permits the cut edge 25 of the carpeting 24 to be snugly and securely brought under the curved contour of the skirt, as shown.

Figure 3:
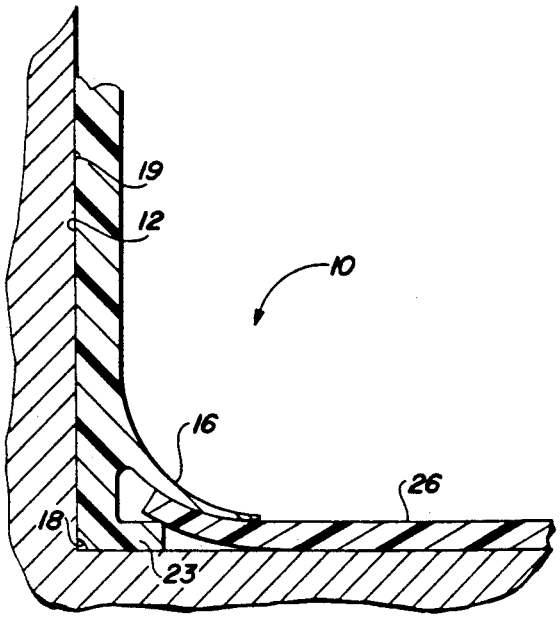

FIG. 3 shows the same strip 10 utilized for hiding the rough edges of intersection of a thin floor material, such as linoleum floor covering 26, which requires the skirt 16 to reach a lower elevation above the floor subsurface than with the carpeting 24 shown in FIG. 2. As illustrated in FIG. 3, the self-hinge 18 permits the bottom part 23 of the strip 10 to be folded 90° in the forward direction, thereby lowering the normal elevation of the skirt 16.

The installation shown in FIG. 3 contemplates that the strip 10 is secured to the wall 19 before the flooring 26 is installed. Thus, as shown the edge of the flooring 26 can be snugly received between the upper surface of the folded part 23 and the part of the lower surface of the skirt 16 adjacent the leading edge 21. It will be appreciated, however, that the flooring 26 can be spaced appropriately out from the wall 19 by an amount equal to the width of the folded portion 23, so that the strip 10 can be installed following installation of the flooring 26. Alternatively, the notch 18 can be used as a cutting line, if desired, and the bottom part 23 removed completely. In either case, the same strip 10 is available for use over either the thick flooring or the thin flooring.

Suitable dimensions of the strip 10 for use with conventional flooring materials are a width or height "A" of 2½", 4" or 6". A skirt line distance "B" above the subfloor or vertical bottom edge 15 of the strip 10 of ½", a recess 18 line distance "C" above the subfloor of ⅛" or ¼", and a width "D" from the back surface 19 of the back portion 12 to the leading edge 21 of the skirt 16 of ¼". Such dimensioning is suitable for standard conventional flooring needs and provides convenient apron or skirt 16 heights for overlapping both ⅛" and ½" flooring materials. It will, of course, be appreciated that dimensioning and particular configuration of the strip 10 will be varied to suit particular needs and preferences.

Those skilled in the art to which the invention relates will realize that various other substitutions and modifications to the described embodiment may be made without departing from the spirit and scope of the invention as defined by the claims appended hereto.

What is claimed is:

1. In combination with a wall, a floor joining said wall and a flooring material of certain thickness covering said floor, an elongated wallbase molding strip of resilient material comprising:

a vertical back portion having front and rear surfaces bounded by top and bottom edges;

a skirt portion extending outwardly and downwardly in a smooth and continuous contour from said front surface of said back portion along a first line intermediate said top and bottom edges to a skirt portion leading edge; and self-hinge means in the form of a recess running longitudinally along said rear surface of said strip along a second line, said recess being dimensioned, configured and adapted for facilitating the folding of a bottom part of said back portion away from a top part of said back portion along a second line intermediate said top and bottom edges, said second line being below said first line;

said bottom part being folded forwardly at said recess, said rear surface being positioned against said wall at said top part and against said floor at said bottom part; and said skirt portion pressing down at said leading edge onto said flooring material, with said contour serving as a smooth and continuous transition from said front surface above said first line to said flooring material.

2. A strip as in claim 1, wherein said recess comprises a V-shaped notch.

3. A strip as in claim 2, wherein said skirt portion is continuously tapered from a thick portion adjacent to said backing portion to a thin feathered portion adjacent a free end thereof.

4. A strip as in claim 1, wherein said second line is generally midway between said bottom edge and said first line, and said first line is less than one-quarter of a distance along said rear surface from said bottom edge to said top edge.

5. A strip as in claim 4, wherein said resilient material is polyvinylchloride.

6. In combination with a vertical wall, a horizontal floor joining said wall and a horizontally disposed flooring material of certain thickness covering said floor, an elongated wallbase molding strip of resilient polymeric material comprising:

a vertical back portion having planar front and rear surfaces bounded by top and bottom horizontal edges;

a tapered skirt portion extending outwardly and downwardly in a smooth and continuous contour from said front surface of said back portion, along a first line parallel to said bottom edge and located less than one-quarter of a distance along said rear surface from said bottom edge, to a feathered skirt portion leading edge; and self-hinge means in the form of a V-shaped notch recess running longitudinally along said rear surface of said strip along a second line parallel to said bottom edge and located generally midway between said bottom edge and said first line, said notch being dimensioned, configured and adapted for facilitating the folding of a bottom part of said back portion away at right angles from a top part of said back portion along a second line between said top and bottom edges, said second line being below said first line;

said bottom part being folded forwardly at said recess, said rear surface being positioned against said wall at said top part and against said floor at said bottom part; and said skirt portion pressing down at said leading edge onto said flooring material, with said front surface above said first line to said flooring material.

7. A strip as in claim 6, wherein said back portion is rounded at said top edge to present a second smooth and continuous contour serving as a smooth and continuous transition from said front surface above said first line to said wall.

8. A strip as in claim 7, wherein said back portion is resiliently prestressed in a rearward direction at said top edge to fit tightly against said wall so as to accommodate slight irregularities in said wall.

9. A strip as in claim 6, wherein said thickness is $\frac{1}{8}''$–$\frac{1}{4}''$.

* * * * *